US006071215A

United States Patent [19]

Raffo et al.

[11] Patent Number: 6,071,215

[45] Date of Patent: Jun. 6, 2000

[54] MULTI-MODE EXERCISE MACHINE

[76] Inventors: David M. Raffo, Hillfarm House Wicker Lane Guilden Sutton, Chester, United Kingdom; Grant David Purvis, 142 Totara Road, Miramar 6003, New Zealand

[21] Appl. No.: 09/025,765

[22] Filed: Feb. 18, 1998

[51] Int. Cl.[7] ..... A63B 69/16; A63B 69/06

[52] U.S. Cl. ..... 482/57; 72/142

[58] Field of Search ..... 482/51, 57, 908, 482/62, 72, 148, 142

[56] References Cited

U.S. PATENT DOCUMENTS

| | | | |
|---|---|---|---|
| 1,850,530 | 3/1932 | Brown | 482/72 |
| 3,966,201 | 6/1976 | Mester | 272/72 |
| 4,140,312 | 2/1979 | Buchmann | 272/73 |
| 4,723,774 | 2/1988 | Monforte | 482/72 |
| 4,798,378 | 1/1989 | Jonas | 482/72 |
| 4,822,032 | 4/1989 | Whitmore et al. | 482/57 |
| 4,974,832 | 12/1990 | Dalebout | 482/72 |
| 5,569,128 | 10/1996 | Dalebout | 482/57 |
| 5,807,211 | 9/1998 | Berryhill | 482/57 |

FOREIGN PATENT DOCUMENTS

| | | | |
|---|---|---|---|
| 923517 | 3/1973 | Canada | 272/38 |
| 2 160 431 | 6/1984 | United Kingdom . | |

OTHER PUBLICATIONS

CVex Product Brochure; Triangle Industries; undated but believed to be before 1989.

CVex Product Brochure; Triangle Industries; Model 601.

*Primary Examiner*—Stephen R. Crow
*Attorney, Agent, or Firm*—Albert Peter Durigon

[57] ABSTRACT

A multi-mode exercise machine has a re-configurable arm member operable in alternate upstanding and recumbent configurations that allows the machine to be used, when the re-configurable arm member is configured in its upright configuration, to provide a first mode of exercise where the user is supported in such an upright position as to be able to exercise at least his/her lower body, and that allows the machine to be used, when the re-configurable arm member is configured in its recumbent configuration, to provide a second mode of exercise, where the user is supported in such a recumbent position as to allow the user to exercise at least his/her upper body. In the presently preferred embodiment, the re-configurable arm member includes a pivotally mounted and self-locking arm member movable between a first, upright position and a second, recumbent position. In the presently preferred embodiment, the first and second exercise modes include cycling and rowing exercise modes.

14 Claims, 5 Drawing Sheets

MULTI-MODE EXERCISE MACHINE

FIELD OF THE INVENTION

This invention is drawn to the field of exercise machines, and more particularly, to a re-configurable exercise machine providing upright and recumbent exercise modes.

BACKGROUND OF THE INVENTION

Numerous machines are known which allow a user to exercise different muscle groups within the body and cardiovascular system at variable rates, on a stationary, free-standing unit. In particular, cycling, rowing and stepping (or walking) machines are all well known as separate units.

Combination cycle/rowing machine type devices are known as exemplified by U.S. Pat. No. 4,822,032 to Whitmore et al., U.S. Pat. No. 3,966,201 to Mester, Canadian patent 923,517 to Kay et al., and the CVex exercise machine model 601. Whitmore et al. disclose a portable unit having cycling pedals and a rope pull connected to a common resistance drive. In one embodiment the unit is shown mounted to a hospital bed for use as a recumbent cycling/rower, and in another embodiment the unit is shown mounted to a frame that requires the assembly and disassembly of separate pieces to convert between upright cycling and recumbent rowing modes.

Mester discloses an exercise machine including hand levers, and a foot pedal assembly, either of which may be used by an upright operator. Kay et al. disclose a portable unit having reciprocating pedals and a rope pull; in one mode, the portable unit is placed on the floor in front of a chair or other support so that the operator may reciprocate the pedals with his or her feet, while in other modes, the operator lies prone on the floor and manipulates either the reciprocating pedals or the rope pull. The CVex exercise machine model 601 discloses a portable unit having cycling pedals and a rope pull from which a horizontal beam extends. In use, the operator sits on the beam and either operates the cycling pedals or rope pull in recumbent position.

The heretofore known single function type machines and combination cycle/rowing machine type devices, however, have been disadvantageous in that they have been difficult to use or otherwise have not considered ergonomic or anthropometric requirements to insure correct posture and other parameters that provide effective exercise while preventing user injury; have not been readily configurable without requiring assembly and disassembly of separate parts; have not provided both upright and recumbent exercise modes or otherwise have not relieved exercise monotony, been cost effective or space-saving; and/or have been complex to manufacture or difficult to maintain.

SUMMARY OF THE INVENTION

Accordingly, it is the principal object of the present invention to disclose an ergonomic and anthropometric exercise machine that enables a user to take exercise in either an upright or a recumbent exercise mode simply by re-configuring the machine and in such a manner that preferably does not require any addition or removal of pieces to convert the machine from upright to recumbent modes.

In accord therewith, a re-configurable exercise machine providing upright and recumbent exercise modes is disclosed that includes an exercise base station of predetermined height; first and second exercise devices mounted to said exercise base station; an elongated arm member mounted for motion to said exercise base station between a first position, wherein at least a portion of said arm is generally above said exercise base station and is operable as a hand hold support, permitting the user to take exercise on one of said exercise devices when the user is in a generally upright position over said exercise base station, and a second position, where said arm extends generally horizontally from said exercise base station and is operable as a body support, permitting the user to take exercise on the other of said exercise devices when the user is in a recumbent position and supported on said arm in said second position.

In the preferred embodiment, said elongated arm has ends and is of predetermined length determined to be greater than said height of said exercise base station; said elongated arm member is mounted at one end for pivoting motion to said exercise base station between said first position, where the other end of said arm is generally above said exercise base station, and said second position; and said first and second exercise devices include a rope pull and cycling pedals.

In further accord therewith, the disclosed re-configurable exercise machine providing upright and recumbent exercise modes further includes means for locking said arm and said exercise base station against relative movement when it is in each of its said first and second positions.

In the preferred embodiment, the locking means includes an elongated beam having ends, that is pivotally connected at one end to the exercise base station, and a connection member that connects the free end thereof to said arm whenever it is in each of its first and its second positions.

In the preferred embodiment, the connection member includes a threaded post mounted to said arm and a locking plate having post receiving apertures that is mounted for motion with said beam.

The presently preferred embodiment of the machine of the invention includes an adjustable, magnetically impeded resistance mechanism in common with the first and second exercise devices, and a single computer adapted for use in either the upright or recumbent exercise modes that is responsive to the revolutions of the magnetically impeded resistance mechanism to display speed, distance, calories burned, and, among others, exercise mode.

BRIEF DESCRIPTION OF THE DRAWINGS

These and other objects, inventive aspects and advantageous features of the present invention will become apparent as the invention becomes better understood by referring to the detailed description of the presently preferred embodiments, and to the drawings, wherein.

DETAILED DESCRIPTION OF THE PRESENTLY PREFERRED EMBODIMENTS

Figures 1, 2:
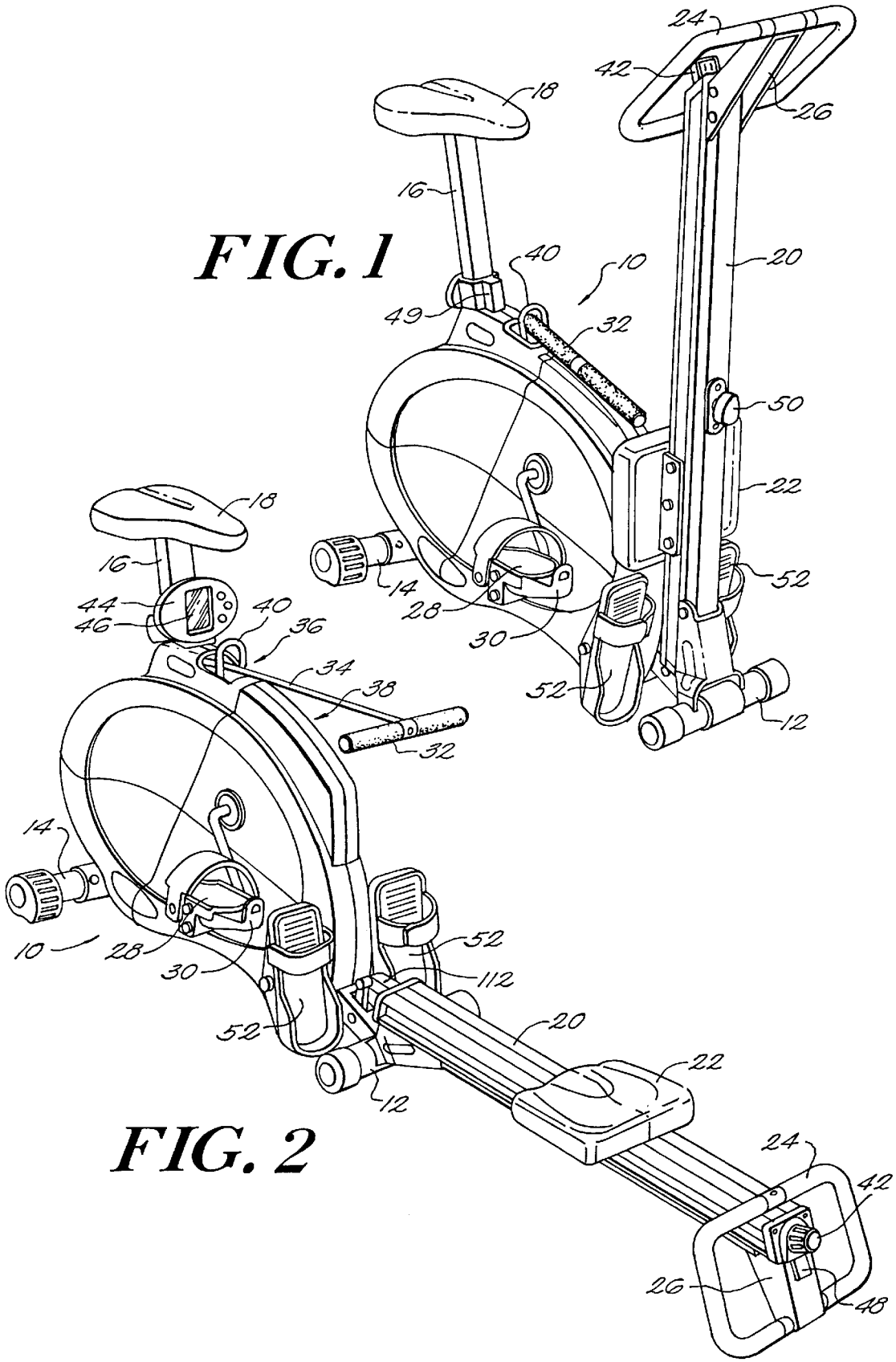
FIG. 1 is a perspective view of the presently preferred embodiment of the re-configurable exercise machine of the invention providing upright and recumbent exercise modes configured in its upright exercise mode.
FIG. 2 is a similar view of the same machine configured in its recumbent exercise mode.

Referring now to FIGS. 1 and 2, the presently preferred embodiment of a combined cycling/rowing machine of the invention comprises a casing or exercise base station 10, which may be molded of plastics, which houses a frame or support structure, a drive assembly, and a common resistance mechanism and associated components, not shown, to be described. At the front and rear of the casing 10 there are respective tubular support legs 12,14. Mounted in the rear to the frame of the casing 10, and upwardly extensible therefrom is a first beam 16, upon which a cycle seat 18 is mounted. Pivotally attached to the frame at the front of the casing 10 is an arm 20 upon which a second seat 22 is slidably mounted.

Laterally extending U-shaped handle bars 24 are provided on an obliquely angled member 26 mounted to arm 20. The handle bar 24 acts as a carriage stop and preferably extends to the front of the arm 20 to improve ergonomic riding position (best seen in FIG. 2). Pedals 28 preferably having toe stops 30 are provided at respective sides of the casing 10 and connect to a sprocket wheel to be described, not shown, inside the casing 10. The toe stops 30 control correct foot position and prevent interference with the rowing seat 22 when the arm 20 is in its first, upright position during peddling action.

At the top of the casing 10 there is a rowing hand hold 32 in the form of a short bar, which is connected at its midpoint to a rope 34 (FIG. 2). The rope 34 extends into the casing 10 via an opening generally designated 36 (FIG. 2), where it passes around a guide roller to be described, not shown, and onto the drive assembly to be described, not shown.

When the hand hold 32 is not in use it can be stored in a position in which it does not impede the normal use of the machine in the other exercise mode (i.e. the upright mode). To this end, hand hold receiving socket generally designated 38 (FIG. 2) is provided. When the machine is to be used in rowing mode, as shown in FIG. 2, the hand hold 32 is moved into a horizontal position, and is used repeatedly to draw the rope 34 out from the exercise base station 10 and then allow it to wind back, in a manner to be described, upon its recovery stroke.

Upstanding U-shaped member 40 mounted to the frame of the casing 10 in confronting relation to the opening 36 provides a storage loop for an end of the hand hold 32 (FIG. 1), and both guides the rope 34 connected to the pull bar 32 during its extraction phase and controls the re-coil action of the pull bar 32 to protect machine components from accidental damage if it were accidentally released during its retraction phase (FIG. 2).

A resistance control knob 42 is provided on the free end of arm 20 for use in adjusting the resistance in either exercise mode. The resistance control knob 42 provides a single tension adjustment point preferably with graduated settings. A computer unit 44 with display panel 46 is mountable adjacent to knob 42 via an electrical connector 48 (FIG. 2) provided therefor on member 26, and is mountable on an electrical connector 49 provided therefor on the top of the exercise base station 10 with the display panel 46 facing the user in the recumbent rowing mode as shown in FIG. 2. The connectors are so programmed as to allow the computer to automatically sense exercise modes in dependence on where the computer is plugged in, enabling the same to automatically change its information processing and display modes.

A locking mechanism to be described that locks arm 20 and the base station 10 against relative motion when the arm 20 in its first, upright position (FIG. 1) and its second, recumbent position (FIG. 2) includes a connection member 50 (FIG. 1) that is located on the arm 20 so as to be accessible from a single, easily accessed point. In the cycling mode, the operator, not shown, uses the connection member 50 in a manner to be described to lock the arm 20 and base station 10 against relative motion whenever the arm 20 is in its first, upright position shown in FIG. 1.

The slidable seat 22 rests at the lowest extent of its slidable travel on the front of the casing 10. If necessary, the rowing footplates 52 may be rotated ninety (90) degrees to clear the cycling pedals 28 when cycling. The operator then mounts the seat 18, and engages the pedals 28 in a cycling action. The computer 44 is mounted in the connector 48. To switch the machine into rowing mode (FIG. 2), the connection member 50 of the locking means is released and the arm 20 is swung down so that the angled end portion 26 and the handle bars 24 rest on the ground and serve as a terminal support. The connection member 50 of the locking means is then engaged in a manner to be described, locking the arm 20 and station 10 against relative motion. The arm 20 is then rigidly held in its second, recumbent position.

The seat 22 is free to slide along the arm 20 and should be moved to a position suitable for the user. The rowing hand hold 32 is put into its horizontal position. The computer 44 is mounted in the connector 49. The user sits on the seat 22 and braces his/her feet against foot rests 52 pivotally connected to base station 10. The user then grasps the hand hold 32 and pulls so as to simulate a rowing motion, with alternate rowing and recovery strokes.

To switch the machine back into cycling mode, it is simply a case of reversing the above procedure. It will be appreciated that no interchange or exchange of parts is required to reconfigure the inventive machine, and that, while preserving all of the important ergonomic or anthropometric parameters for either exercise mode, it is fairly quick and easy to accomplish the changeover between the two exercise modes of this machine.

Figure 4:
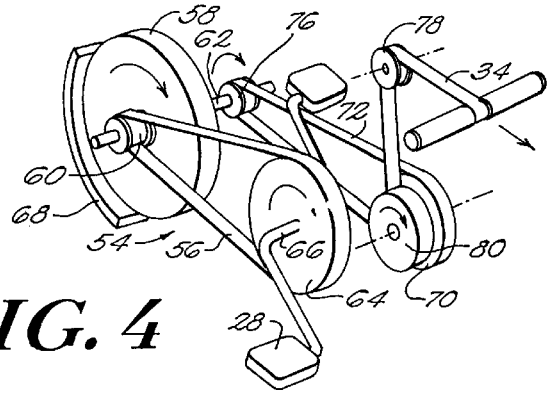
FIG. 4 is a pictorial view useful in explaining the operation of the presently preferred embodiment of the common resistance mechanism and of the drive assembly of the machine of the invention.
Figure 3:
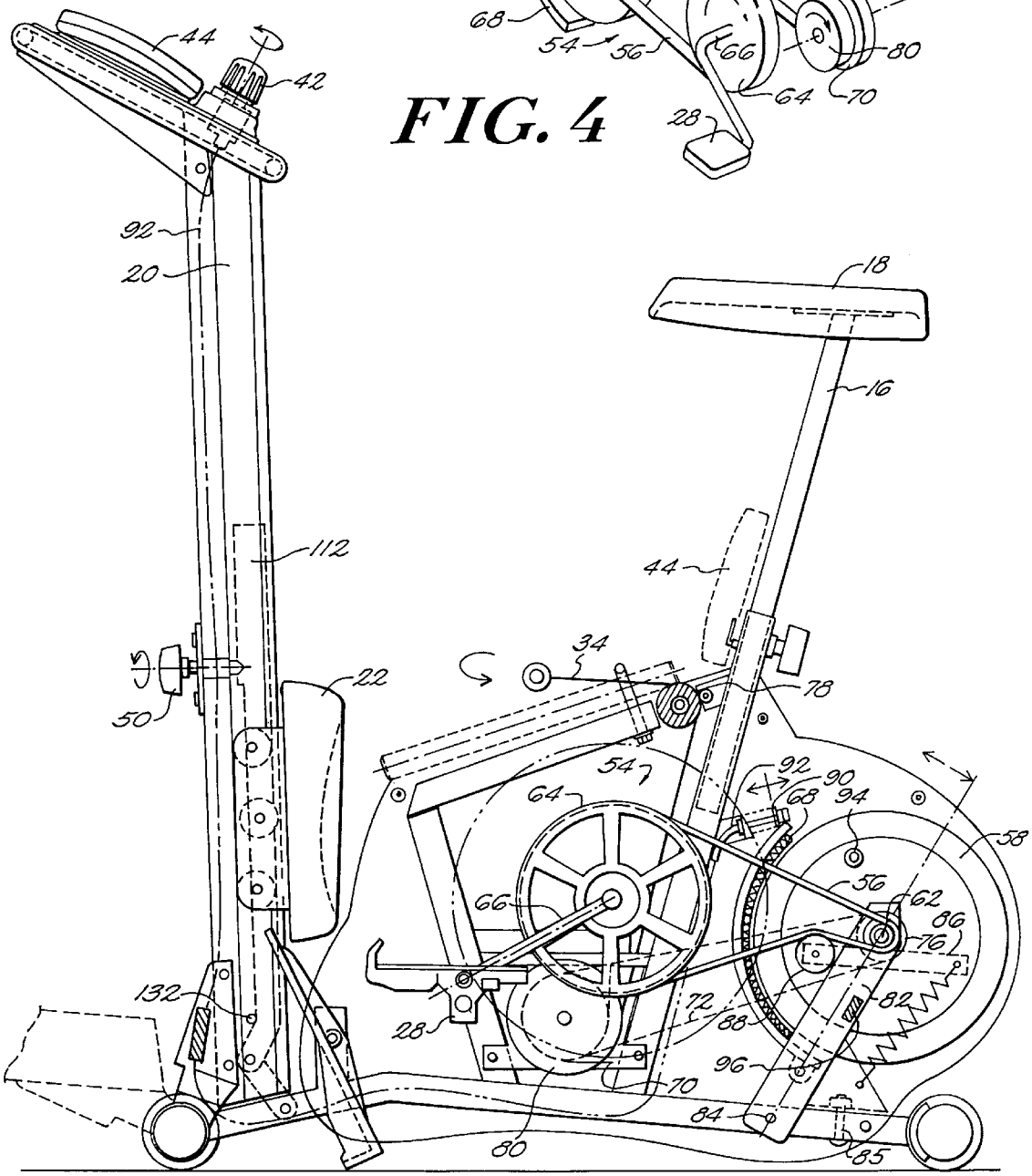
FIG. 3 is a partially sectional, side elevational view of the same machine with the casing of the exercise base station removed.

Turning to FIGS. 3 and 4 the internal drive assembly and common resistance mechanism of the presently preferred embodiment will now be described. As illustrated, the drive assembly in the form of the drive wheel assembly generally designated 54 is linked by a drive belt 56 to a common resistance mechanism in the form of a magnetically impeded resistance wheel 58 mounted via a one-way clutch 60 (FIG. 1) on shaft 62.

A sprocket wheel 64 for a cycle crank shaft 66 carrying pedals 28 is connected to drive wheel assembly 54 by the drive belt 56. The belt may be in the form of the belt or chain or similar. An arcuate magnet 68 is mounted adjacent to wheel 58 and serves to magnetically impede its rotation in a well-known manner. A rowing drive wheel 70 rotatably mounted on a shaft, not shown, is connected to the drive wheel assembly 54 via belt 72 that connects with a second one-way clutch 76 mounted on shaft 62. Rope 34 is connected to the rowing drive wheel 70 via guide wheel 78 to spring-biased take up reel 80 mounted for rotation with the rowing drive wheel 70.

As best seen in FIG. 4, and dealing firstly with the cycling mode, when the pedals 28 are operated the crank shaft 66 drives the sprocket wheel 64, which, in turn, drives the resistance wheel 58 via belt 56. Back peddling has no effect, as the clutch 60 disengages, and because of the clutch 76, the cycling action has no effect on the rowing drive 70.

In the rowing mode, as the rope 34 is pulled out the rowing drive 70 is driven clockwise, and this motion is transmitted via belt 72 and clutch 76 to the shaft 62, turning the resistance wheel 58 mounted thereon. As the spring-loaded retraction reel 80 retracts rope 34 during the rowing recovery cycle, because of the one-way clutch 76, that action has no effect on the rest of the drive assembly 54. As will be appreciated, resistance wheel 58 is driven in the same direction by each drive mode.

As shown in FIG. 4, resistance wheel 58 is preferably mounted in a swinging arm 82 that provides for ease of assembly. The swinging arm 82 is pivotally connected at 84 to the exercise base station bottom frame and, during resistance wheel insertion, it is first pivoted towards the front of the exercise base station 10 to receive the resistance wheel 58 and belts, and then it pivots towards the rear under the weight of the inserted wheel and locked in place by means of attachment member 85. A slack take up arm 86 having a spring biased roller 88 that rides against belt 56 is pivotally attached to the distal end of the swing arm 82.

A caliper adjustment 90 is mounted between the frame of the casing 10 and the arcuate magnet 68 at one of its chassis's ends, the other of which is pivotally attached to the swing arm 82 at a location adjacent its proximate end. Cable 92 is threaded via an adjustable connector 93 (FIG. 5) between the caliper 90 through the arm 20 and to the adjustment knob 42 to control the angle of the arcuate magnet 68 and therewith the effective resistance of the wheel 58. The magnet 68 is preferably spring-biased to always return to the wheel and is limited by a stop, not shown, from ever contacting the wheel surface.

A magnet 94 is mounted for rotation with the resistance wheel 58. A pickup sensor 96 is mounted to the swing arm 82 in position to pickup the magnet 94 with each revolution of the wheel 58. The computer 44 is electrically connected to the sensor 96 and is responsive to the sensor output signal to calculate and display speed, distance traveled and calories burned, among others, when the machine of the invention is being operated in either of its cycling or rowing modes.

Figure 5:
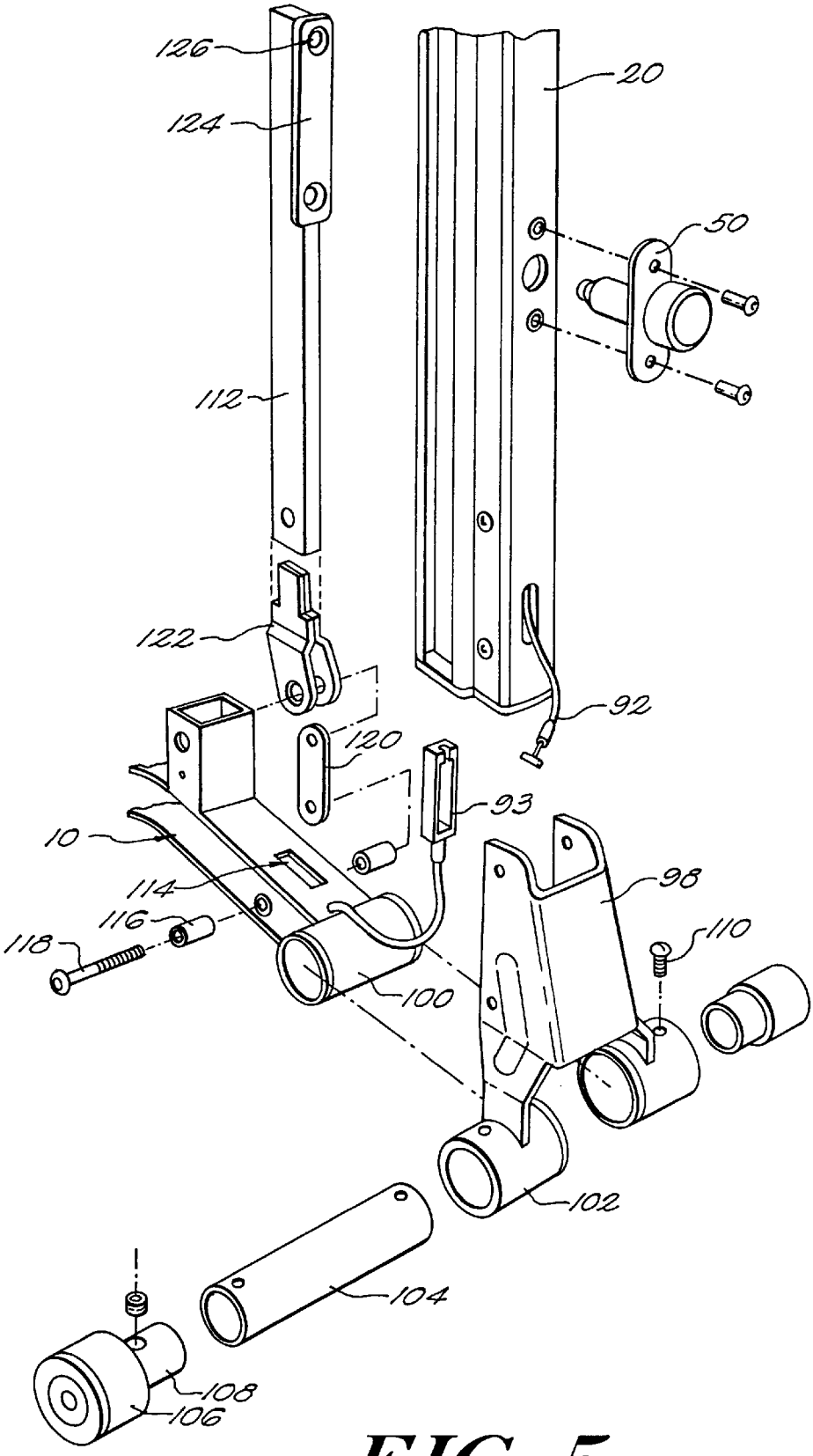
FIG. 5 is an exploded view of the presently preferred embodiment of the locking arm assembly of the machine of the invention.

With reference now to FIG. 5, the construction of the preferred embodiment of the locking arm assembly will now be described. As can be seen, the arm 20 is fastened at its proximate end to a bracket 98, which, in turn, is pivotally mounted to the front of the exercise base station 10. To this end, a bearing 100 attached to the forward end of the base station 10 cooperates with bearings 102 attached to the bracket 98 to receive member 104 that acts as the axle for the pivot assembly. The bearing 100 sits inside the tubular cross piece 12 (FIGS. 1 and 2), which, in turn, is connected to the frame of the exercise station 10. Wheel assemblies 106 having shaft ends 108 are secured in the pivot by means of a pin 110 that fastens elements 108, 104, 102 and therefore element 98 together, thereby providing a substantially rigid pivot assembly that eliminates any lateral and longitudinal slop in the pivot bearing when the arm 20 is between, or in either its upright or recumbent positions.

The proximate end of a locking beam 112 is pivotally mounted to the forward end of the exercise base station 10 in an aperture generally designated 114 provided therefor on a bearing 116 attached to the frame by attachment member 118 via a compound pivot consisting of first end second links 120, 122. The first and second links 120, 122 of the compound pivot preferably are fashioned of pressed steel. As best seen in FIGS. 2 and 3, the locking beam 112 is constrained for sliding motion inside the re-configurable arm 20.

A locking plate 124, preferably of machined steel, is attached to the distal end of the locking beam 112. Tapered holes generally designated 126 are provided on the forward face of the locking plate 124 that cooperate in a manner to be described with connector member 50 attached to arm 20 to secure the arm 20 and base station 10 against relative motion in either its first, upright position or its second, recumbent position. As best seen in FIGS. 1 and 2, the connector member 50 is conveniently located, and by its controlled engagement and release to be described the arm 20 of the inventive machine may be reconfigured between its first, upright, cycling and second, recumbent, rowing positions without requiring change or interchange of parts.

Figure 6A:
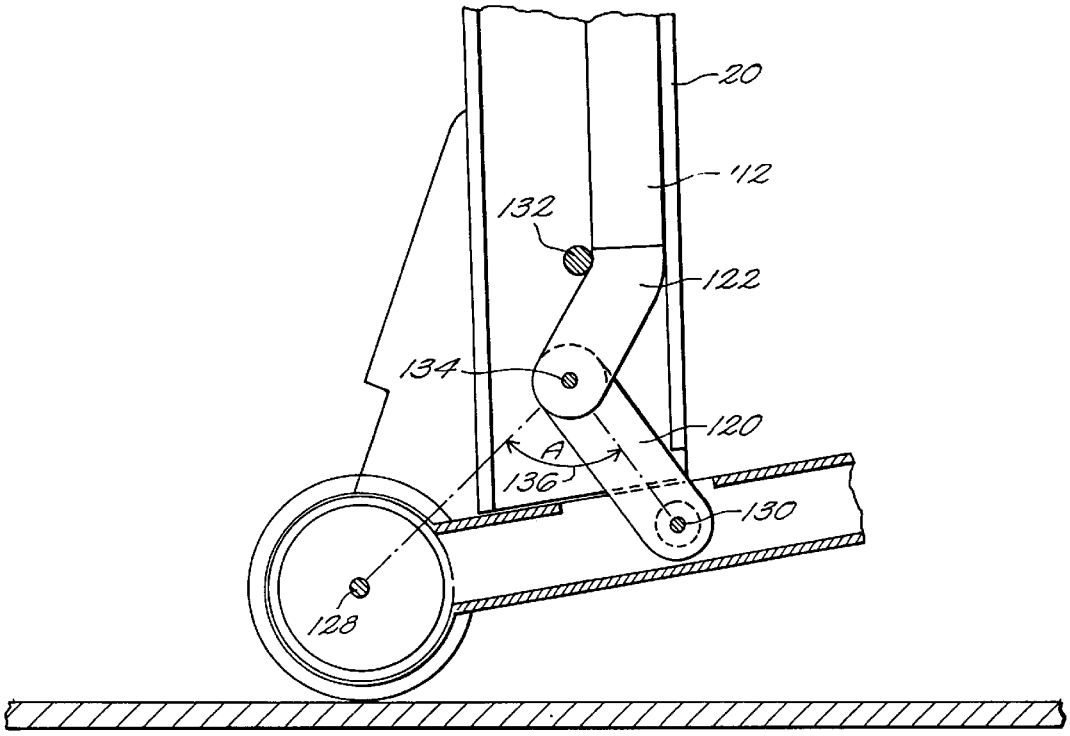
FIG. 6 illustrates in the FIGS. 6A,6B thereof schematic diagrams showing the beam lock geometry of the presently preferred embodiment of the locking arm assembly of the invention respectively in its first and second positions.

With reference now to FIG. 6A, the operation of the preferred embodiment of the locking arm assembly of the present invention in its first, upright position will now be described. FIG. 6A depicts the foot of arm 20 that pivots about main pivot point 128, the foot of locking beam 112 that pivots about locking beam pivot point 130 and the manner that the locking beam 112 is constrained for parallel sliding motion inside the arm 20. During motion towards its first, upright position, the locking beam 112 slides up inside the arm 20 until it reaches its upright position when it abuts the station 10, where the second link 122 of the locking beam 112 wedges against a carriage stop bolt 132 provided therefor on arm 20. The wedging action provided by contact with the second link 122 eliminates any sliding tolerance and forces the locking beam 112 against the confronting inside face of the arm 20, whereby the beam 112 is prevented from sliding any further up inside the arm 20.

Once it is locked in place by means of the connector member 50 (FIGS. 1, 2,3, 5, and 7) in a manner to be described, the locking beam 112 cannot move up or down inside the arm 20 and the compound pivot point 134 of the locking beam 112 is thereby fixed in space. This locks the arm 20 and station 10 against relative motion because the angle 136 marked "A" is near ninety (90) degrees in the presently preferred embodiment, which means the axis of the link 120 is parallel to the tangent angle of the pivot arc through point 134. This puts the link 120 in tension, preventing its movement and locking the whole assembly in position.

Figure 6B:
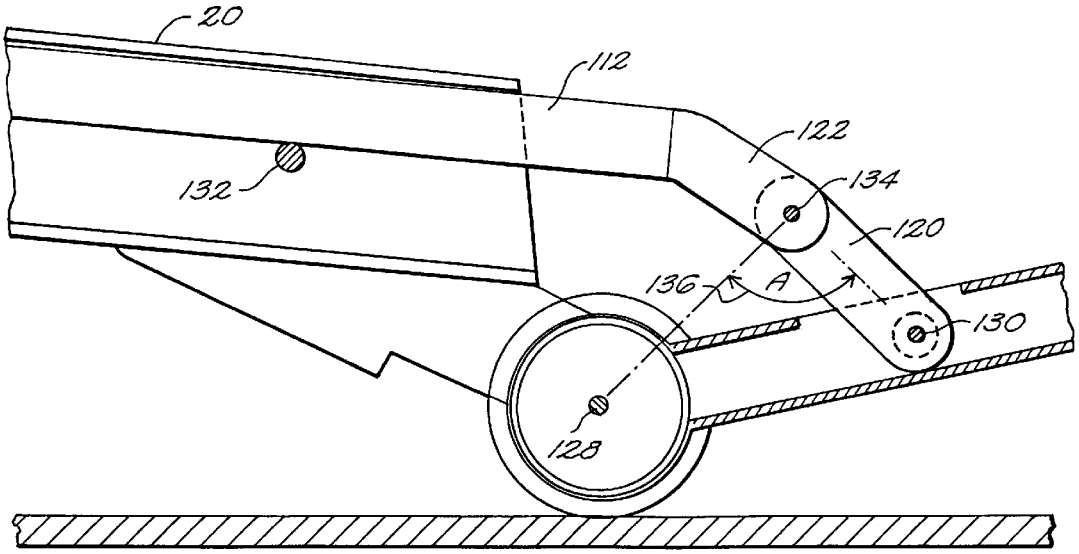

With reference now to FIG. 6B, the operation of the preferred embodiment of the locking arm assembly of the present invention in its second, recumbent position will now be described. During motion towards its second, recumbent position, the locking beam 112 slides down and out inside the arm 20 until it reaches its recumbent position, where the connector member 50 (FIGS. 1, 2,3, 5, and 7) is used to lock it in place in a manner to be described. It may be noted that the carriage stop bolt 132 holds the locking beam 112 upwards parallel to the arm 20. As in FIG. 6A, because of the angle A being near to ninety (90) degrees, the compound link is put in compression when the frame tries to pivot up in reaction to the action of using the rope pull. But because the pivot 134 is fixed, and because the link will not rotate due to the alignment of the axes, the locking arm assembly and frame stay rigid and locked in the second, recumbent position.

Figure 7:
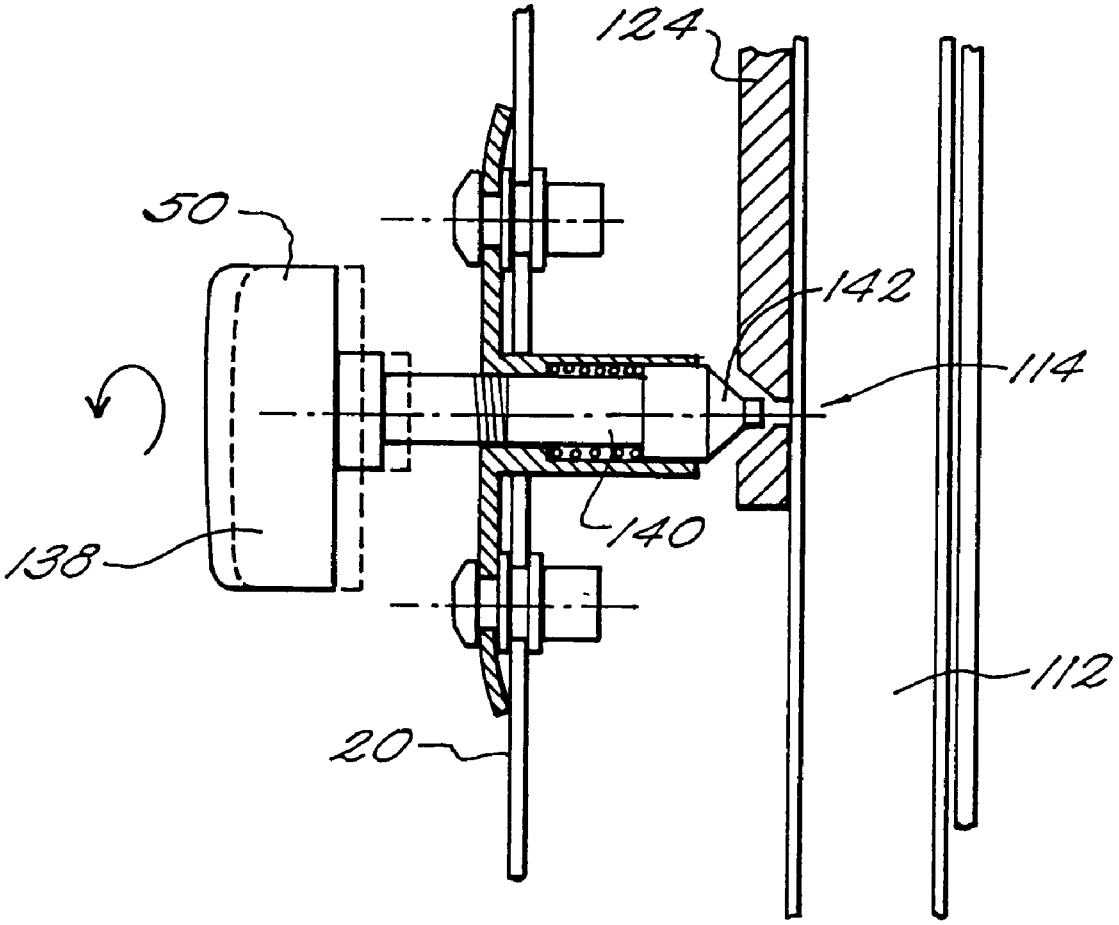
FIG. 7 is a pictorial diagram illustrating the connection member of the presently preferred embodiment of the locking arm assembly of the present invention.

With reference now to FIG. 7, the operation of the presently preferred embodiment of the connector member of the locking arm assembly of the present invention will now be described. The connector member 50 includes a threaded hand knob 138. The hand knob 138 is connected to and turns a spring-loaded, threaded locking pin 140 that terminates in a conically tapered head 142. To lock the locking beam 112 to the arm 20 in either its first, upright position or its second, recumbent position, the hand knob 138, held into the threaded "nut" by the spring bias, is turned to screw the locking pin 140 into one of the apertures 114 provided therefor on the locking plate 124.

It may be noted that the spring bias is inwards to engage the locking pin 140 into the apertures 114, when the screw thread is disengaged. This is a safety features so that the arm will not "fold" unless the spring is pulled to fully disengage the locking pin 140 from the apertures 114, and therefore allow the locking beam 112 to move. The spring bias then re-engages the locking pin 140 into the next aperture 114, and aligns the thread ready to be tightened.

To unlock the locking beam 112 from the arm 20 in either its first, upright position or its second, recumbent position, the hand knob 138 is turned to unscrew the locking pin 140 out of one of the apertures 114 provided therefor on the locking plate 124 and pulled against the spring bias. In position inside the apertures the conically tapered head 142 of the locking pin 140 is securely seated, which both takes out manufacturing slop while maintaining the desired rigidity of the arm relative to the chassis in either its first, upright position or its second, recumbent position.

Many modifications of the presently disclosed invention will become apparent to those of skill in the art who have benefitted therefrom. For example, means other than a caliper may be provided for adjusting the effective resistance of the magnetic resistance element. Resistance elements other than magnetic resistance elements may be employed, such as inertial fly wheels with adjustable tensioning straps, hydrodynamically impeded impellers, aerodynamically impeded propellers, and, among others, electro-mechanical resistance devices. Self-locking arm assemblies other than that of the presently preferred embodiment may also be employed; for example, the locking beam may be pivotally or otherwise attached at locations on the exercise base station other than at its bottom, the locking beam may not be constrained for parallel sliding motion within the re-configurable arm, and a pneumatic or other cylinder could be employed to lift, position and lock the arm.

It should also be noted that other than the self-locking arm assembly of the presently preferred embodiment could also be employed; for example, the arm could be movably mounted to the base station for motion between upright and recumbent positions and otherwise locked in its upright and recumbent positions. Re-coil mechanisms other than recoil springs such as elastically tensioned recoil mechanisms could be employed to take up the rope pull during recovery phase. Exercise devices other than or in addition to cycling and rowing devices, such as a stair step exercise device operable when the machine of the invention is used in its first, upright position could be employed. Drive assemblies of different configuration could also be employed. Other connection members than spring-loaded loaded locking pins and co-operative apertures may also the employed without departing from the inventive concepts.

What is claimed is:

1. A re-configurable exercise machine having selectably configurable upright and recumbent configurations respectively providing upright and recumbent exercise modes, comprising:

an exercise base station having ends and adapted for use by a user who selectably mounts said exercise base station in one of an upright position generally over said exercise base station and a recumbent position generally laterally confronting one of said ends of said exercise base station;

at least first and second exercise devices mounted to said exercise base station, said first exercise device adapted for use by said user who mounts said exercise base station in said upright position generally over said exercise base station, and said second exercise device adapted for use by said user who mounts said exercise base station in said recumbent position generally laterally confronting said one of said ends of said exercise base station; and a reconfigurable elongated arm member mounted for motion to said exercise base station between a first generally upright position, wherein said re-configurable arm is configured as a hand-hold usable by said user who selectable mounts said exercise base station in said upright position generally over said exercise base station, providing, with said first exercise device, said upright exercise mode; and between a second, generally recumbent, horizontal position, wherein said re-configurable arm is configured as a body-support usable by said user who selectably mounts said exercise base station in said recumbent position generally laterally confronting said one of said ends of said exercise base station, providing, with said second exercise device, said recumbent exercise mode.

2. The re-configurable exercise machine providing upright and recumbent exercise modes of claim 1, wherein said exercise base station is of predetermined height, wherein said elongated arm has ends and is of predetermined length determined to be greater than said height of said exercise base station, and wherein said elongated arm member is mounted at one end for pivoting motion to said exercise base station between said first position, wherein the other, free end of said arm is generally above said exercise base station, and said second position.

3. The re-configurable exercise machine providing upright and recumbent exercise modes of claim 1, wherein said second exercise device includes a rope pull.

4. The re-configurable exercise machine providing upright and recumbent exercise modes of claim 1, wherein said first exercise device includes cycling pedals mounted to said exercise base station and a seat mounted to said exercise base station generally upwardly extending from said exercise base station.

5. The re-configurable exercise machine providing upright and recumbent exercise modes of claim 1, further including means for locking said arm and said base station against relative motion when it is in each of its said first and second positions.

6. The re-configurable exercise machine providing upright and recumbent exercise modes of claim 5, wherein the locking means includes an elongated beam that is connected to the exercise base station, and a releasable connection member that connects the beam to said arm whenever it is in one of its first and its second positions.

7. The re-configurable exercise machine providing upright and recumbent exercise modes of claim 6, wherein the elongated beam has a free end and an end that is pivotally connected to the exercise base station, wherein said arm has an end pivotally connected to said exercise base station, and wherein the releasable connection member is operative in each of said first and second positions to connect the free end of the beam to said free end of said arm.

8. The re-configurable exercise machine providing upright and recumbent exercise modes of claim 6, wherein the connection member includes a post mounted to said arm and wherein said beam has walls providing a post receiving aperture.

9. The re-configurable exercise machine providing upright and recumbent exercise modes of claim 1, wherein a resistance mechanism is mounted to said exercise base station, to which the first and second exercise devices are operatively connected.

10. The re-configurable exercise machine providing upright and recumbent exercise modes of claim 1, further including a sensor mounted to the exercise base station providing a signal having information representative of exercise performance, and a computer responsive to said signal adapted for use in either said upright or recumbent exercise modes having a display providing user readable exercise performance information.

11. The re-configurable exercise machine providing upright and recumbent exercise modes of claim 10, further including first and second connectors each operatively connected to said sensor mounted at different predetermined first and second locations on said exercise base station for receiving said computer, said predetermined first and second locations determined such that, when said computer is received by said connector at said first location, said display is visible by said user who selectable mounts said exercise base station in said upright position generally over said exercise base station, and further determined such that, when said computer is received by said connector at said second location, said display is visible by said user who selectable mounts said exercise base station in said recumbent position generally laterally confronting said one of said ends of said exercise base station.

12. A multi-mode exercise machine providing an upright cycle in upright cycle mode and a recumbent rower in recumbent rower mode, comprising:

a base exercise station having sides, ends and a top, and at least one resistance mechanism mounted therewithin;

cycle pedals, and a cycle seat, adapted for use in said upright cycle mode and respectively mounted to said sides and to said top of said exercise base station with said cycle pedals operatively connected to said at least one resistance mechanism;

a rowing device adapted for use in said recumbent rower mode mounted to said exercise base station and operatively connected to said at least one resistance mechanism;

an elongated dual-mode arm having ends pivotally connected at one of its ends to an end of said exercise base station for motion between an upright position, wherein it is modally operative in one of its dual-modes as a handlebar, providing, with said cycle seat and cycle pedals mounted to said exercise base station, said upright cycle operative in said upright cycle mode; and a horizontal position, wherein it is modally operative in the other of its dual-modes as a body support, providing, together with said rowing device mounted to said exercise base station, said recumbent rower in said recumbent rower mode.

13. The multi-mode exercise machine of claim 12, wherein said rowing device is a handhold.

14. The re-configurable exercise machine providing upright and recumbent exercise modes of claim 11, wherein said first and second connectors are so programmed as to allow said computer to respectively sense said upright and recumbent exercise modes and to display information appropriate to each exercise mode when received therein.

* * * * *